US009941613B2

(12) United States Patent
Zhao

(10) Patent No.: US 9,941,613 B2
(45) Date of Patent: Apr. 10, 2018

(54) ELECTRICAL CONNECTOR FOR A BUS BAR

(71) Applicant: Tyco Electronics (Shanghai) Co. Ltd., Shanghai (CN)

(72) Inventor: Yuqiang Zhao, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/348,304

(22) Filed: Nov. 10, 2016

(65) Prior Publication Data

US 2017/0133779 A1 May 11, 2017

(30) Foreign Application Priority Data

Nov. 10, 2015 (CN) ..... 2015 1 0760800

(51) Int. Cl.
*H01R 12/52* (2011.01)
*H01R 12/70* (2011.01)
*H01R 12/72* (2011.01)

(52) U.S. Cl.
CPC ..... *H01R 12/7088* (2013.01); *H01R 12/52* (2013.01); *H01R 12/7005* (2013.01); *H01R 12/7082* (2013.01); *H01R 12/721* (2013.01); *H01R 12/722* (2013.01)

(58) Field of Classification Search
None
See application file for complete search history.

(56) References Cited

U.S. PATENT DOCUMENTS 4,349,237 A * 9/1982 Cobaugh ..... H05K 7/1435 361/802
5,931,701 A * 8/1999 Pan ..... H01R 23/70 439/637
6,328,605 B1 * 12/2001 Walker ..... H01R 12/52 439/59
6,472,606 B2 * 10/2002 Yamakawa ..... H01R 9/24 174/149 B
6,607,115 B2 * 8/2003 Kobayashi ..... B60R 16/0238 174/59
2015/0349440 A1 * 12/2015 Seok ..... H01R 12/737 439/327

* cited by examiner

*Primary Examiner* — Tho D Ta
(74) *Attorney, Agent, or Firm* — Barley Snyder

(57) ABSTRACT

An electrical connector is disclosed. The electrical connector has an insulating housing extending in a longitudinal direction and having a first insertion slot and a second insertion slot parallel to the first insertion slot, a plurality of first terminals disposed separately on an upper portion of the first insertion slot along the longitudinal direction, a plurality of second terminals disposed on the upper portion of the first insertion slot and spaced apart from the plurality of first terminals, a plurality of third terminals disposed separately on a lower portion of the first insertion slot along the longitudinal direction, a plurality of fourth terminals disposed separately on an upper portion of the second insertion slot along the longitudinal direction, and a balance structure disposed on an end of the insulating housing in the longitudinal direction.

23 Claims, 6 Drawing Sheets

ELECTRICAL CONNECTOR FOR A BUS BAR

CROSS-REFERENCE TO RELATED APPLICATION

This application claims the benefit of the filing date under 35 U.S.C. § 119(a)-(d) of Chinese Patent Application No. 201510760800.8, filed on Nov. 10, 2015.

FIELD OF THE INVENTION

The present invention relates to an electrical connector, and more particularly, to an electrical connector connecting to a bus bar.

BACKGROUND

In known electrical systems, power is transmitted to a circuit board or other electrical component through a bus bar and a power connector. The bus bar generally comprises a planar body having two opposite surfaces and is made of conductive material such as copper. The bus bar is positioned in a reception space between two rows of opposite conductive terminals of the power connector, the opposite surfaces of the bus bar each engaged with a row of conductive terminals to form an electrical connection.

If the conductive terminals are arranged asymmetrically, when the bus bar is inserted in between, the conductive terminals contact and abut the opposite surfaces of the bus bar differently, such that the bus bar is deflected by a certain angle in the reception space due to an unbalanced force applied by the conductive terminals. Bus bar deflection results in poor stability and poor reliability of the electrical connection between the power connector and the bus bar.

SUMMARY

An object of the invention, among others, is to provide an electrical connector forming a more reliable electrical connection with a bus bar. The electrical connector has an insulating housing extending in a longitudinal direction and having a first insertion slot and a second insertion slot parallel to the first insertion slot, a plurality of first terminals disposed separately on an upper portion of the first insertion slot along the longitudinal direction, a plurality of second terminals disposed on the upper portion of the first insertion slot and spaced apart from the plurality of first terminals, a plurality of third terminals disposed separately on a lower portion of the first insertion slot along the longitudinal direction, a plurality of fourth terminals disposed separately on an upper portion of the second insertion slot along the longitudinal direction, and a balance structure disposed on an end of the insulating housing in the longitudinal direction.

BRIEF DESCRIPTION OF THE DRAWINGS

The invention will now be described by way of example with reference to the accompanying figures, of which.

DETAILED DESCRIPTION OF THE EMBODIMENT(S)

Figure 1A:
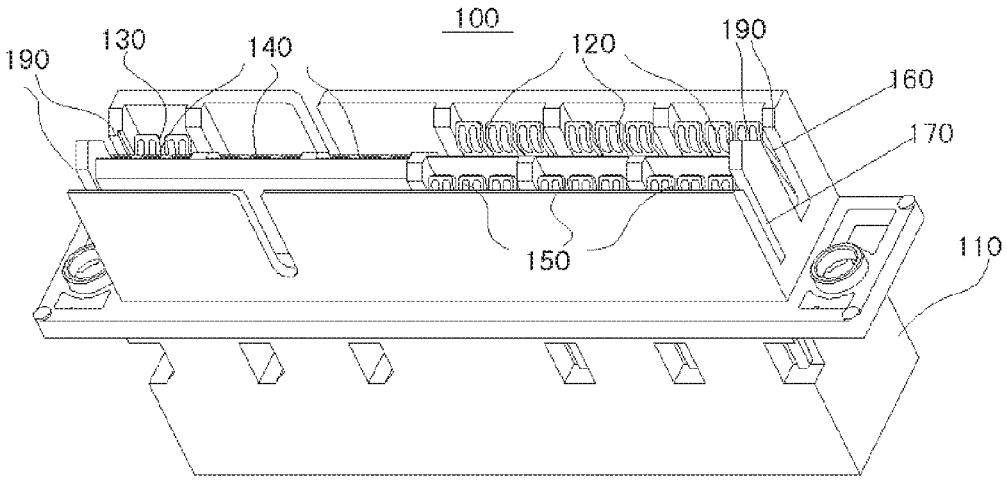
FIG. 1*a* is a perspective view of an electrical connector according to the invention.

Embodiments of the present disclosure will be described hereinafter in detail with reference to the attached drawings, wherein the like reference numerals refer to the like elements. The present disclosure may, however, be embodied in many different forms and should not be construed as being limited to the embodiments set forth herein; rather, these embodiments are provided so that the present disclosure will be thorough and complete, and will fully convey the concept of the disclosure to those skilled in the art.

Figure 1B:
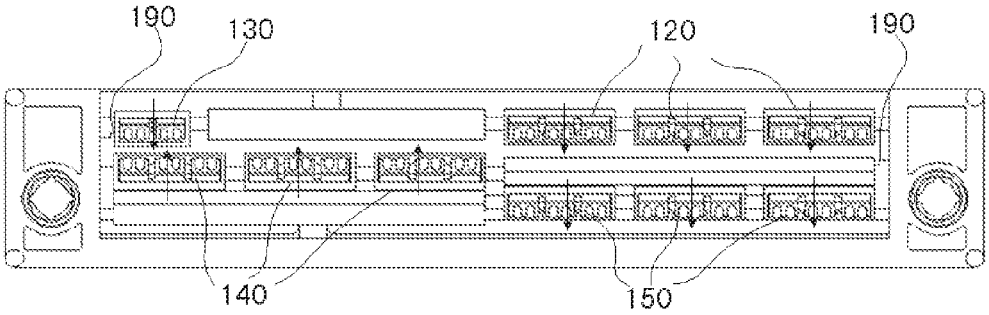
FIG. 1*b* is a front view of the electrical connector of FIG. 1*a;*
Figure 1C:
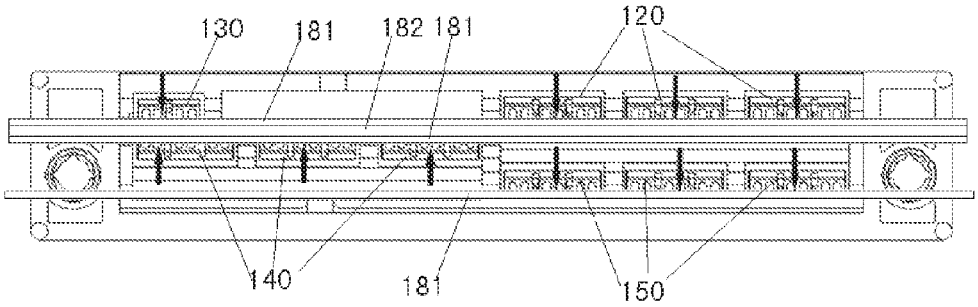
FIG. 1*c* is a front view of the electrical connector of FIG. 1*a* and a bus bar.

An electrical connector 100 according to the invention is shown in FIGS. 1*a*, 1*b*, and 1*c*. The electrical connector 100 comprises an insulating housing 110, a plurality of sets of power terminals 120, a set of sensing terminals 130, a plurality of sets of return terminals 140, and a plurality of sets of grounding terminals 150. Each of the plurality of sets of power terminals 120 has at least one power terminal 120, the set of sensing terminals 130 has at least one sensing terminal 130, each of the plurality of sets of return terminals 140 has at least one return terminal 140, and each of the plurality of sets of grounding terminals 150 has at least one grounding terminal 150.

The insulating housing 110, as shown in FIG. 1*a*, extends in a longitudinal direction. The insulating housing 110 has a first insertion slot 160 and a second insertion slot 170 parallel to the first insertion slot 160.

As shown in FIG. 1*b*, the plurality of sets of power terminals 120 are disposed separately on an upper portion of the first insertion slot 160 along the longitudinal direction, and are located at a first half of the insulating housing 110, the first half on a right of the insulating housing 110 in FIG. 1*b*. The set of sensing terminals 130 is also disposed on the upper portion of the first insertion slot 160, but is located at an opposite second half of the insulating housing 110 and is spaced apart from the power terminals 120, the second half on a left of the insulating housing 110 in FIG. 1*b*. The plurality of sets of return terminals 140 are disposed separately on a lower portion of the first insertion slot 160 along the longitudinal direction, and are located at the second half of the insulating housing 110. The three sets of grounding terminals 150 are disposed separately on an upper portion of the second insertion slot 170 along the longitudinal direction, and are located in the first half of the insulating housing. The plurality of sets of return terminals 140 and the plurality of sets of grounding terminals 150 are spaced apart from each other in the longitudinal direction.

In a direction perpendicular to the longitudinal direction, as shown in FIG. 1*b*, the sensing terminals 130 and the power terminals 120 are located at a same first level, the return terminals 140 are located at a second level lower than the first level, and the grounding terminals 150 are located at a third level lower than the second level. In the direction perpendicular to the longitudinal direction, one of the plurality of sets of return terminals 140 is aligned with the set of sensing terminals 130, and the plurality of sets of power terminals 120 is aligned with the plurality of sets of grounding terminals 150.

Figure 4A:
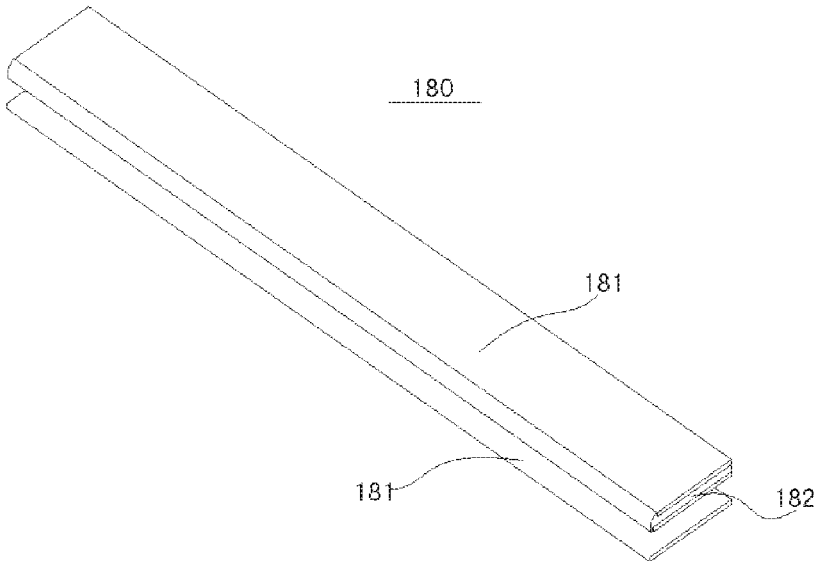
FIG. 4*a* is a perspective view of a bus bar.
Figure 4B:
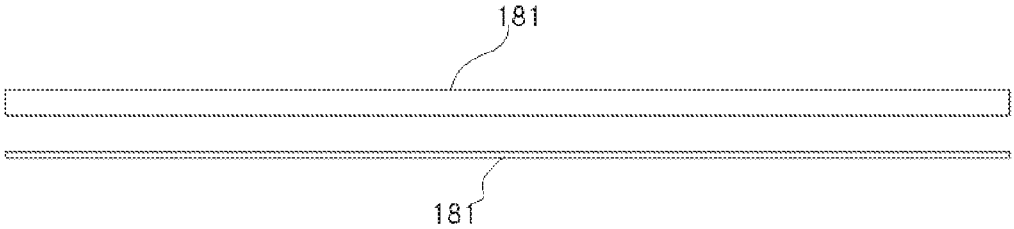
FIG. 4*b* is a front view of the bus bar of FIG. 4*a*.
Figure 4C:
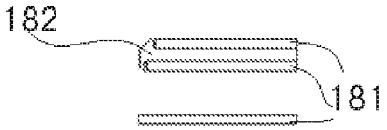
FIG. 4*c* is a side view of the bus bar of FIG. 4*a*.

The first insertion slot 160 and the second insertion slot 170 receive a bus bar 180 shown in FIGS. 4*a*-4*c*. The bus bar 180 has multiple layers of plates 181. The plates 181 may be formed of copper. The multiple layers of plates 181 may be integrally formed or may be assembled to form the bus bar 180. Two adjacent layers of plates 181 are separated from each other by an insulating layer 182 of the bus bar 180. In the shown embodiment, the bus bar 180 has three layers of plates 181, two layers of which are inserted in the first insertion slot 160 and are separated from each other by an insulating layer 182, and one remaining layer 181 of which is inserted in the second insertion slot 170.

In FIG. 1*c*, the directions of the forces, applied by each of the power terminals 120, the sensing terminal 130, the return terminals 140, and the grounding terminals 150 to one of the plates 181 are indicated by the arrows directing upwards or downwards. As can be seen from the directions of the applied forces indicated by the arrows, the forces applied by the terminals of the electrical connector 100 to the copper plate are asymmetrical and imbalanced.

In order to solve the problem of unbalanced forces applied to the bus bar 180, the electrical connector 100 has a first balance structure 190 as shown in FIGS. 1*a* and 1*b*. The first balance structure 190 is disposed on at least one of two ends of the first insertion slot 160 and the second insertion slot 170 of the insulating housing 110 in the longitudinal direction. In the embodiment shown in FIGS. 1*a* and 1*b*, two first balance structures 190 are disposed at two ends of the first insertion slot 160 in the longitudinal direction, respectively; one of the balance structures 190 is disposed at an end of the first insertion slot 160 and opposed to the power terminals 120, and the other of the two balance structures 190 is disposed at an opposite end of the first insertion slot 160 and opposed to the return terminals 140. In an alternative embodiment, the first balance structure 190 is only disposed at the end of the first insertion slot 160 and opposed to the power terminals 120. In a further alternative embodiment, the first balance structure 190 is only disposed at the opposite end of the first insertion slot 160 and opposed to the return terminals 140.

The first balance structure 190 may be formed as a balance rib or a balance bar disposed on the end of the first insertion slot 160 and/or the second insertion slot 170. The first balance structure 190 may be integrally formed with the insulating housing 110. Alternatively, the first balance structure 190 may be separately mounted on the insulating housing 110, for example, by a screw, bonding, soldering and the like.

The first balance structure 190 contacts the bus bar 180 located within the first insertion slot 160 and the second insertion slot 170. When the bus bar 180 is mounted in the electrical connector 100, the end of the first balance structure 190 projecting towards the first insertion slot 160 or the second insertion slot 170 will come into contact with a layer of plate 181 of the bus bar 180 to at least partially bear the forces applied, by each terminal, to the bus bar 180 mated together with the electrical connector 100. The first balance structure 190, by partially bearing the applied forces, enables the bus bar 180 to not be rotated or deflected by the forces of the terminals in the electrical connector 100.

Figure 2A:
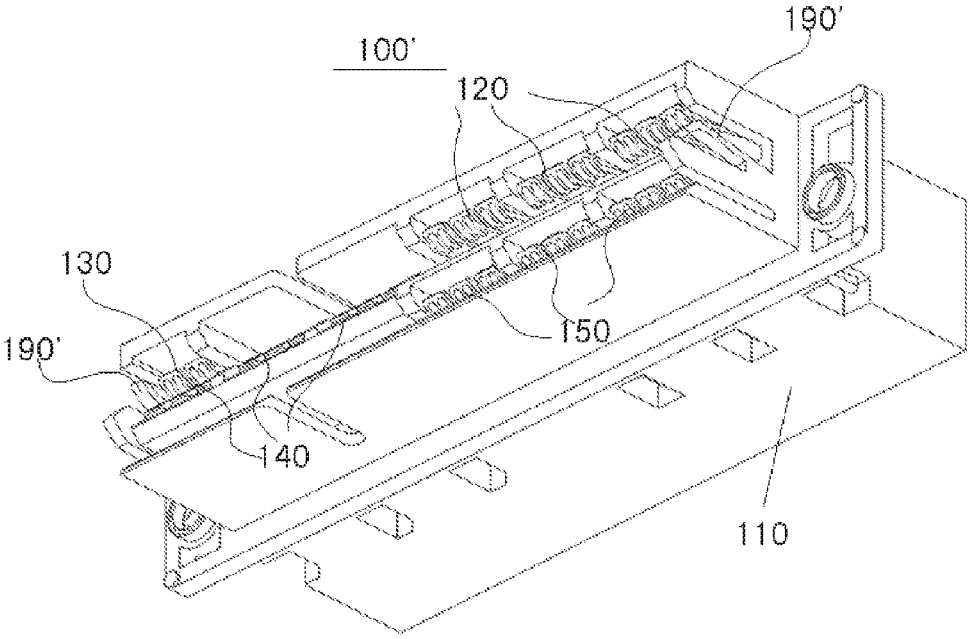
FIG. 2*a* is a perspective view of an electrical connector according to another embodiment of the invention.
Figure 2B:
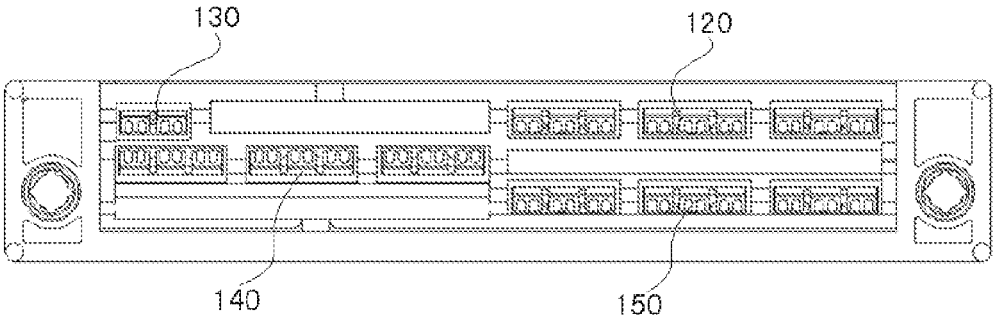
FIG. 2*b* is a front view of the electrical connector of FIG. 2*a;*
Figure 2C:
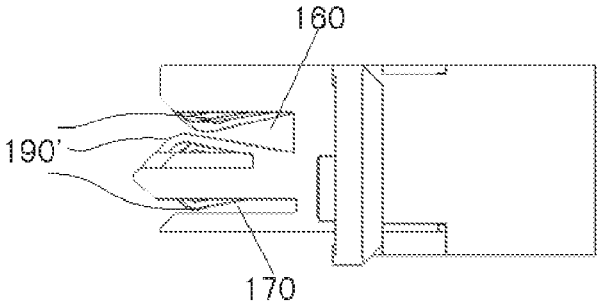
FIG. 2*c* is a side view of the electrical connector of FIG. 2*a;*

An electrical connector 100' according to another embodiment of the invention is shown in FIGS. 2*a*-2*c*. The electrical connector 100' is similar to the electrical connector 100 described above with respect to FIGS. 1*a*-1*c*, but the electrical connector 100' has an second balance structure 190' rather than a first balance structure 190. In FIGS. 2*a*-2*c*, the same components as those of the embodiment shown in FIGS. 1*a*-1*c* are indicated by the same reference numerals.

The second balance structure 190', as shown in FIGS. 2*a* and 2*c*, is an elastic balance projecting outwards from the insulating housing 110 into the first insertion slot 160 and/or the second insertion slot 170. The second balance structure 190' comes into elastic contact with the bus bar 180, partially bearing forces applied to the bus bar 180 by the terminals such that the bus bar 180 is not rotated or deflected in the electrical connector 100'. The second balance structure 190' has a substantial Y-shape, and two branch arms of the Y-shaped come into contact with layers of plate 181 of the bus bar 180 located in the first insertion slot 160 and the second insertion slot 170, respectively. The second balance structure 190' is formed of a plastic material.

Figure 3A:
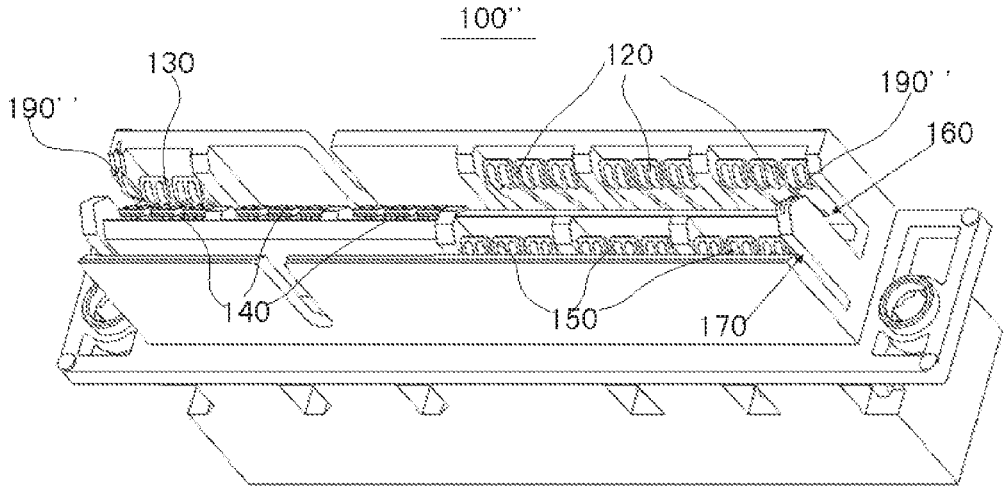
FIG. 3*a* is a perspective view of an electrical connector according to another embodiment of the invention.
Figure 3B:
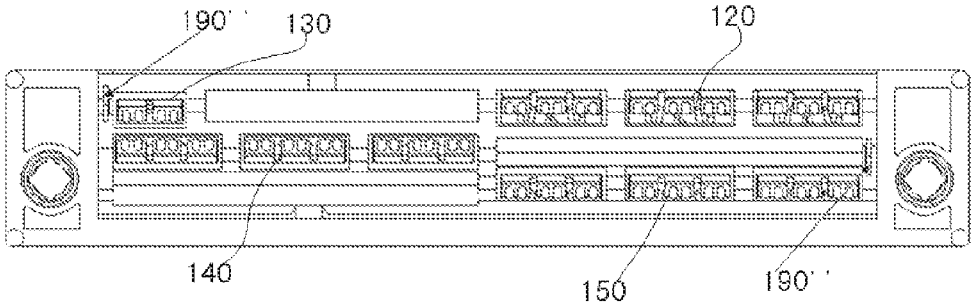
FIG. 3*b* is a front view of the electrical connector of FIG. 3*a;*
Figure 3C:
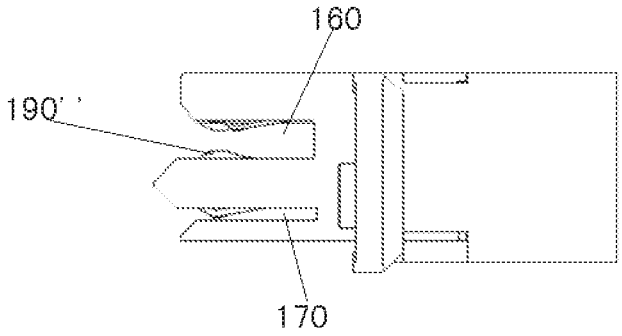
FIG. 3*c* is a side view of the electrical connector of FIG. 3*a;*

An electrical connector 100" according to another embodiment of the invention is shown in FIGS. 3*a*-3*d*. The electrical connector 100" is similar to the electrical connector 100' described above with respect to FIGS. 2*a*-2*c*, but the electrical connector 100" has a metal third balance structure 190" rather than a plastic second balance structure 190'. In FIGS. 3*a*-3*c*, the same components as those of the embodiment shown in FIGS. 2*a*-2*c* are indicated by the same reference numerals.

Figure 3D:
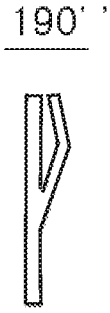
FIG. 3*d* is a side view of an elastic balance of the electrical connector of FIG. 3*a;*

The third balance structure 190", as shown in FIGS. 3*a*, 3*c*, and 3*d*, is an elastic balance projecting outwards from the insulating housing 110 into the first insertion slot 160 and/or the second insertion slot 170. The third balance structure 190" comes into elastic contact with the bus bar 180, partially bearing forces applied to the bus bar 180 by the terminals such that the bus bar 180 is not rotated or deflected in the electrical connector 100". The third balance structure 190" has a substantial Y-shape, and two branch arms of the Y-shaped come into contact with layers of plate 181 of the bus bar 180 located in the first insertion slot 160 and the second insertion slot 170, respectively. The third balance structure 190" is fixed on the insulating housing 110 by soldering, bonding, or the like.

Advantageously, according to the electrical connector 100, 100', 100" of the present invention, an unbalanced arrangement of the terminals of the electrical connector 100, 100', 100" may be used to shorten the width of the connector 100, 100', 100", reducing the cost thereof and saving space. Further, the balance structure 190, 190', 190" is provided to prevent unbalanced forces from being applied to the bus bar 180 resulting from the unbalanced arrangement of the terminals, improving the electrical connection to the bus bar 180 and the performance reliability of the product.

What is claimed is:

1. An electrical connector, comprising:

an insulating housing extending in a longitudinal direction and having a first insertion slot and a second insertion slot parallel to the first insertion slot, a bus bar inserted into the first insertion slot and the second insertion slot in an insertion direction perpendicular to the longitudinal direction;

a plurality of first terminals disposed separately on an upper portion of the first insertion slot along the longitudinal direction;

a plurality of second terminals disposed on the upper portion of the first insertion slot and spaced apart from the plurality of first terminals;

a plurality of third terminals disposed separately on a lower portion of the first insertion slot along the longitudinal direction;

a plurality of fourth terminals disposed separately on an upper portion of the second insertion slot along the longitudinal direction; and a balance structure disposed on an end of the insulating housing in the longitudinal direction.

2. The electrical connector of claim 1, wherein the balance structure receives the bus bar in the insertion direction.

3. The electrical connector of claim 1, wherein the balance structure contacts the bus bar within the first insertion slot and the second insertion slot and prevents the bus bar from being rotated or deflected.

4. The electrical connector of claim 3, wherein the balance structure is formed as a balance rib or balance bar on the insulating housing.

5. The electrical connector of claim 3, wherein the balance structure contacts the bus bar on a same surface of the bus bar as the first terminals and the second terminals.

6. The electrical connector of claim 3, wherein the bus bar has multiple layers of plates.

7. The electrical connector of claim 6, wherein the plates are formed from copper.

8. The electrical connector of claim 6, wherein the bus bar has an insulating layer separating two adjacent layers of the multiple layers of plates.

9. The electrical connector of claim 3, wherein the first terminals and fourth terminals are located at a first half of the insulating housing, and the second terminals and third terminals are located at an opposite second half of the insulating housing.

10. The electrical connector of claim 9, wherein, in a direction perpendicular to the longitudinal direction, one of the third terminals is aligned with one of the second terminals, and the first terminals are aligned with the fourth terminals.

11. The electrical connector of claim 10, wherein the third terminals are spaced apart from the fourth terminals in the longitudinal direction.

12. The electrical connector of claim 11, wherein the first terminals comprise three sets of first terminals, the third terminals comprise three sets of third terminals, and the fourth terminals comprise three sets of fourth terminals.

13. The electrical connector of claim 12, wherein the first terminals are power terminals, the second terminals are sensing terminals, the third terminals are return terminals, and the fourth terminals are grounding terminals.

14. The electrical connector of claim 11, wherein, in the direction perpendicular to the longitudinal direction, the first terminals and the second terminals are located at a same first level, the third terminals are located at a second level lower than the first level, and the fourth terminals are located at a third level lower than the second level.

15. The electrical connector of claim 14, wherein the balance structure is disposed at each of two ends of the first insertion slot in the longitudinal direction.

16. The electrical connector of claim 6, wherein the bus bar has three layers of plates, two layers are inserted in the first insertion slot and one layer is inserted in the second insertion slot.

17. The electrical connector of claim 16, wherein the balance structure is formed as an elastic balance.

18. The electrical connector of claim 17, wherein the elastic balance projects outward from the insulating housing and contacts the bus bar.

19. The electrical connector of claim 18, wherein the elastic balance is formed of plastic or metal.

20. The electrical connector of claim 19, wherein the elastic balance has a Y-shape with two branch arms, the two branch arms contacting the layers of plates of the bus bar disposed in the first insertion slots and the second insertion slot, respectively.

21. The electrical connector of claim 1, wherein the first terminals, second terminals, and third terminals asymmetrically contact the bus bar inserted into the first insertion slot.

22. The electrical connector of claim 21, wherein the fourth terminals asymmetrically contact the bus bar inserted into the second insertion slot.

23. An electrical connector, comprising:

an insulating housing extending in a longitudinal direction and having an insertion slot receiving a bus bar having two opposite surfaces;

a plurality of terminals disposed separately on an upper portion of the insertion slot and a lower portion of the insertion slot along the longitudinal direction, the plurality of terminals asymmetrically abutting the two opposite surfaces of the bus bar; and a balance structure disposed on an end of the insulating housing in the longitudinal direction, the balance structure contacting the bus bar to balance forces applied by the plurality of terminals to the bus bar and prevent rotation or deflection of the bus bar.

* * * * *